US007832581B2

(12) United States Patent
Van Cromvoirt

(10) Patent No.: US 7,832,581 B2
(45) Date of Patent: Nov. 16, 2010

(54) CLOSURE AND METHODS FOR PLACING AND REMOVING SUCH A CLOSURE

(75) Inventor: Johannes Antonius Maria Van Cromvoirt, Waalwijk (NL)

(73) Assignee: Marita de Beer Holding B.V., Soest (NL)

( * ) Notice: Subject to any disclaimer, the term of this patent is extended or adjusted under 35 U.S.C. 154(b) by 864 days.

(21) Appl. No.: 10/548,784

(22) PCT Filed: Mar. 12, 2004

(86) PCT No.: PCT/NL2004/000179

§ 371 (c)(1),
(2), (4) Date: Feb. 9, 2006

(87) PCT Pub. No.: WO2004/080836

PCT Pub. Date: Sep. 23, 2004

(65) Prior Publication Data

US 2006/0231520 A1 Oct. 19, 2006

(30) Foreign Application Priority Data

Mar. 12, 2003 (NL) ..... 1022901

(51) Int. Cl.
*B65D 39/00* (2006.01)

(52) U.S. Cl. ..... 215/355; 215/247; 215/249; 215/294; 215/307; 215/360; 215/361; 220/237

(58) Field of Classification Search ..... 215/247, 215/249, 294, 307, 355, 359, 360, 361; 220/237
See application file for complete search history.

(56) References Cited

U.S. PATENT DOCUMENTS

| | | | | |
|---|---|---|---|---|
| 280,503 | A * | 7/1883 | Newton | 215/307 |
| 2,479,862 | A * | 8/1949 | Payne | 215/359 |
| 2,940,629 | A | 6/1960 | Cros | |
| 3,247,995 | A * | 4/1966 | Jensen | 215/307 |
| 4,098,422 | A * | 7/1978 | Slomski | 215/355 |

FOREIGN PATENT DOCUMENTS

| | | | |
|---|---|---|---|
| DE | 650 525 | C | 9/1937 |
| DE | 11 81 577 | B | 11/1964 |
| DE | 11 94 722 | B | 6/1965 |
| DE | 76 07 603 | U | 9/1976 |
| FR | 1 036 609 | A | 9/1953 |
| FR | 1 067 065 | A | 6/1954 |

* cited by examiner

*Primary Examiner*—Anthony Stashick
*Assistant Examiner*—Elizabeth Volz
(74) *Attorney, Agent, or Firm*—The Webb Law Firm, P.C.

(57) ABSTRACT

The invention relates to a closure for a liquid container, comprising a plug manufactured from at least partially flexible material with a recess which is arranged at least substantially in axial direction in the plug and which is accessible on at least one side, and an operating member protruding outside the plug and displaceable in the recess such that a force exerted by the operating member on the recess in the plug can be modified by displacing the operating member. The invention also relates to methods for placing such a closure into a liquid container and removing thereof from a liquid container.

16 Claims, 2 Drawing Sheets

CLOSURE AND METHODS FOR PLACING AND REMOVING SUCH A CLOSURE

BACKGROUND OF THE INVENTION

1) Field of the Invention

The invention relates to a closure for a liquid container, comprising a plug manufactured from at least partially flexible material. The invention also relates to methods for placing such a closure into an opening in a liquid container and removing thereof from an opening in a liquid container.

2) Description of the Prior Art

The closing of liquid containers is generally known. In addition to closures of rigid materials (screw caps, lids, breakable closures and so on), large-scale use is made of closures of flexible sealing material. Examples hereof are flexible plugs and corks. Particularly when closing (drink) bottles, and more particularly wine bottles, corks are applied on a large scale. Such corks are traditionally made from natural cork (usually from the cork oak), although the use of 'corks' manufactured from (foamed) plastic materials has recently been on the rise. The drawback of both types of cork is that, when they are fully placed in the liquid container, they can only be removed with an assist means (corkscrew), which may be inconvenient in use. A further drawback is that only by exerting very considerable force can existing corks be removed and (re)placed in an opening in a liquid container.

The object of the present invention is to provide a closure for a liquid container with a plug which is manufactured from flexible material and which can be removed from a liquid container without auxiliary tool and which can be replaced in simple manner in an opening of a liquid container.

SUMMARY OF THE INVENTION

The invention provides for this purpose a closure having a plug and an operating member. In a preferred embodiment the forces exerted by the operating member are variable such that the size of the plug can be modified. Such a closure has the advantage that the clamping force with which the plug can be placed in an opening of a liquid container, such as for instance the neck of a bottle, can be regulated. It thus becomes possible to simplify placing and removal of the plug, while a good fitting of the plug onto the opening can be ensured in the situation where the plug connects onto the opening. The clamping force possibly exerted by the plug or the volume of the plug can after all be regulated by displacing the operating member. The closure can be moved into an opening or out of an opening with a relatively small resistance (limited volume) or even wholly without resistance, while at the moment an anchoring of the closure in the opening is desired the resistance of the plug on the opening can be increased (increase of volume of the plug). A medium-tight connection of the plug on a liquid container can thus be realized without related great forces being necessary to remove and place the plug. Another significant advantage of the closure according to the invention is that in order to remove the plug from an opening in a liquid container (for instance the above mentioned neck of a bottle), even when the plug has been placed wholly into the opening, it is possible to grasp the operating member protruding outside the plug. A separate auxiliary tool for opening (for instance a corkscrew) hereby becomes unnecessary. Another advantage of the closure according to the present invention is that, because replacing becomes simpler, it also provides the additional functionality whereby reclosing becomes simpler; it is anticipated that the closure will result in better and more frequent reclosing of already opening liquid containers. The closure can also be used in combination with a succession of diverse liquid containers. Conversely, it is also very well possible to envisage the closure being discarded after use with a particular liquid container (a disposable variant).

In a preferred variant of the closure according to the present invention, the operating member is displaceable relative to the plug between an active position, in which the operating member exerts a force on the recess in the plug, and a release position in which the operating member exerts no force, or at least a smaller one, on the recess in the plug. This can for instance be realized in that the recess arranged in the plug is formed such that it has a wall part enclosing an angle with the axis of the recess and/or in that the surface of the operating member in contact with the wall of the recess has a wall part enclosing an angle with the axis of the recess. The recess and the operating member can thus be given a conical form.

In yet another embodiment variant, the recess in the plug is accessible from two sides. Such a passage reduces the volume of the plug (and therefore the use of material in the production of the plug). A further advantage is that the operating member can thus be readily provided with anchoring means for non-releasable coupling of the plug and the operating member; for instance due to parts of the operating member situated on either side of the opening and having a larger cross-section that the associated openings on both sides in the plug. Because the plug is manufactured from a more flexible material than the operating member, it is possible to envisage a thickened part of the operating member being forced through the (flexible) recess during manufacture of the closure. For a good (preferably medium-tight) fitting of the plug onto a liquid container, the plug is preferably provided with a sealing ring enclosing a side of the plug remote from the recess.

In a preferred variant the part of the operating means protruding outside the plug is provided with a grip, such as for instance a finger grip or an eye. Such a grip makes it easy to displace the operating member relative to the plug, and can moreover have a further function in hanging up the closure (optionally with attached liquid container).

For proper operation the plug is manufactured from a material with a greater flexibility than the flexibility of the material from which the operating member is made. It will not therefore be the operating member which first deforms, but the plug. The plug and the operating member can be manufactured from a plastic, for instance thermoplastic polyolefins, with the advantage that such material is inexpensive, can react little with foodstuffs, and can be processed without very much of an environmental impact. So as to limit adhering of the plug to a liquid container, a lubricant can be incorporated into the plastic of the plug (and optionally also the plastic of the operating member).

In yet another variant, the closure is provided with anchoring means for the purpose, in a position in which the operating member exerts a force on the wall of the recess in the plug, of mutually anchoring the operating member and the plug with a determined clamping force. Such anchoring means can be formed by raised patterns in the co-acting sides of the plug and/or the operating member.

When the wall of the recess in the plug and the side of the operating member co-acting with the recess are profiled such that the contact surface between the recess and the plug is limited, it will be possible to limit or prevent possibly occurring adhesion of the co-acting sides. It is desirable here that at least the wall of the recess in the plug or the side of the operating member co-acting with the recess comprises at least one endless elevation encircling the operating member; such an annular elevation can provide a medium-tight connection of the plug and the operating member, whereby the closure as a whole can close in medium-tight manner.

To allow the escape of an overpressure out of the liquid container, the operating member can be provided with a passage opened on one side, which passage connects onto at least one channel which leads to the surface of the operating member in contact with the recess in the plug. Thus is created a passage from the inside of the liquid container to the connection between the plug and the operating member. The operating member and the plug connect to each other with a manually adjustable closing force. That is, the connection of the plug and the operating member determines the pressure at which the 'pressure-relief valve', in the form of the sealed passage, opens. Such a limiting of the overpressure in the liquid container is more controlled than a possible alternative limiting defined by the connection of the plug on the liquid container; this is not very precise in view of the large dimensional tolerances with which liquid containers (necks of bottles) are embodied in practice.

The invention also provides a method for placing a closure as described above in a liquid container. The limited force according to step A) is here related to the greater force according to step C). 'Limited' and 'greater' must therefor be deemed as relative indications and not as absolute values. The advantages of this method have already been described above with reference to the closure according to the invention. The plug is herein preferably placed with a bias in the entry to the liquid container during operating step B). A good fitting of the plug onto the opening is hereby ensured despite the possible dimensional tolerances in the dimensioning of the opening in a liquid container.

The invention furthermore provides a method for removing a closure as described above from a liquid container. So as to correspond as well as possible to the usual movement for opening a wine bottle, the operating member is preferably displaced in a direction away from the liquid container during operating step E).

BRIEF DESCRIPTION OF THE DRAWINGS

The invention will be further elucidated on the basis of the non-limitative exemplary embodiments shown in the following figures, in which.

DETAILED DESCRIPTION OF THE PREFERRED EMBODIMENTS

Figure 1A:
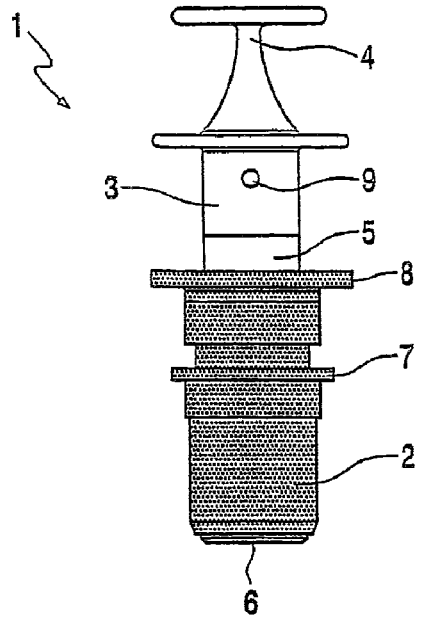
FIG. 1A shows a side view of a closure according to the invention in a release position.

FIG. 1A shows a closure 1 with a plug 2 manufactured from a more flexible material, through which runs a less flexible operating member 3. Operating member 3 is provided with a grip 4 with which a person can grasp operating member 3. A core 5 also forming part of operating member 3 is only partly visible since it is situated for the greater part in the hollow interior of plug 2. Core 5 is formed conically such that it becomes narrower at a greater distance from grip 4. The side of operating member 3 remote from grip 4 is provided with a widened outer end 6 with which plug 2 and operating member 3 are held together. Plug 2 is provided with a sealing ring 7 which provides sealing to a liquid container, not shown in this figure, in which plug 2 is placed. Plug 2 is also provided with a stop edge 8 to prevent plug 2 entering too far into a liquid container. In the relative position of plug 2 and operating member 3 shown in this figure, the periphery of plug 2 is relatively limited.

Figure 1B:
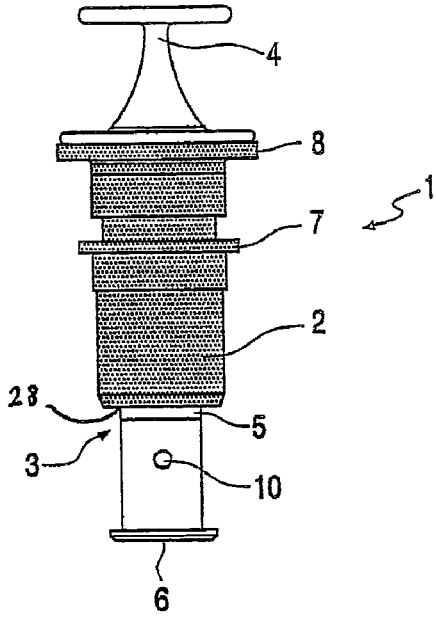
FIG. 1B is a side view of a closure shown in FIG. 1A in a fixing position.

FIG. 1B once again shows closure 1 with plug 2 and operating member 3, although now in a situation in which operating member 3 is displaced relative to plug 2 compared to the situation shown in FIG. 1A. Operating member 3 is now carried further through plug 2, whereby the conical core 5 presses the plug 2 apart such that the size thereof is increased relative to the situation shown in FIG. 1A. Also shown in FIGS. 1A and 1B are holes 9, 10 arranged in operating member 3, the function of which will be indicated with reference to the following figures.

Figure 1C:
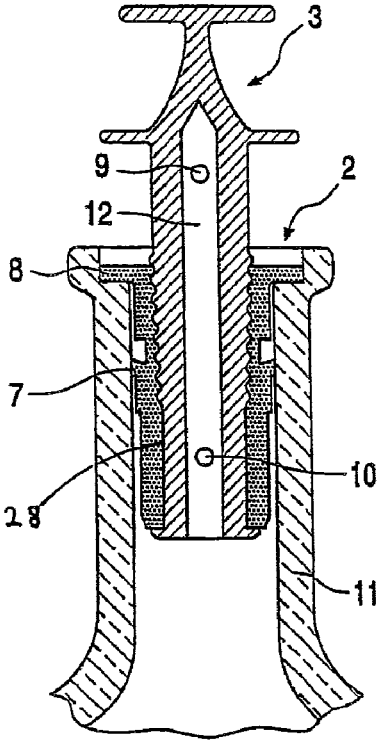
FIG. 1C shows a cross-section through the closure shown in FIGS. 1A and 1B during placing thereof in the neck of a bottle.

In FIG. 1C the closure 1 is placed in the neck of a bottle 11 in the position shown in FIG. 1A. Plug 2 contacts the inner side of the neck of the bottle 11 such that sealing ring 7 is compressed and provides a first sealing effect. Plug 2 is carried so far into the neck of the bottle 11 that stop edge 8 lies against the neck of the bottle 11. Shown clearly in this figure is that operating member 3 is provided with a hollow core 12 which opens into the bottle and onto which connect holes 9, 10.

Figure 1D:
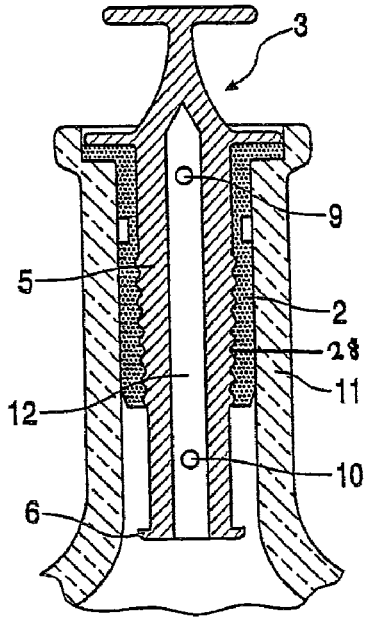
FIG. 1D shows a cross-section through the closure shown in FIGS. 1A-1C after fixing of the closure in the neck of a bottle.

In FIG. 1D closure 1 is anchored in the neck of the bottle 11 in that operating member 3 has now been carried further into the neck of the bottle 11. The conical surface of core 5 now presses against the inner side of the recess 28 arranged in plug 2, whereby the bias exerted by the plug on the neck of the bottle has increased; closure 1 is thus anchored in the neck of the bottle 11. Also shown is that the surface of core 5 takes a profiled form for a good fixation of operating member 3 relative to plug 2 in the position in which they are manually placed. Opening 9 in core 5 of operating member 3 now connects to plug 2 and thus fulfils the function of a pressure relief valve. The force with which operating member 3 is pressed into plug 2 determines the pressure at which overpressure will escape through opening 9. Opening 10 has the advantage that it connects the space around the part of operating member 3 protruding under plug 2 to the hollow core 12, so that even when the widened end 6 of operating member 3 is in contact with liquid, gas exchange remains possible between the spaces separated from each other by the liquid.

Figure 1E:
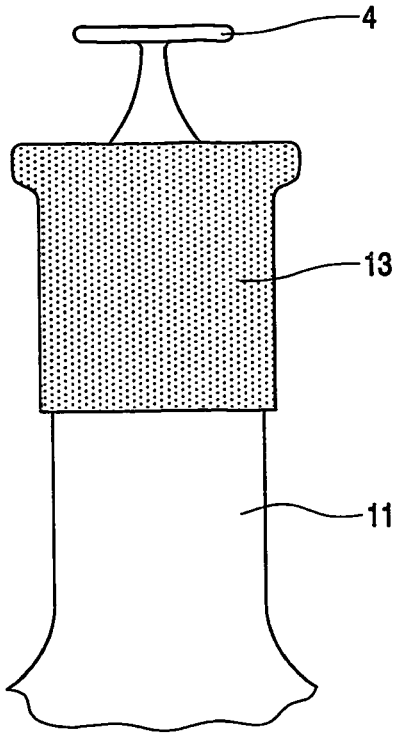
FIG. 1E is a side view of the neck of a bottle with the closure shown in FIGS. 1A-1D placed therein.

FIG. 1E shows a side view of the neck of the bottle 11 with the grip 4 of closure 1, still just visible above it, in a situation as shown in FIG. 1D. Grip 4 gives a bottle an appearance clearly differing from the traditional, and can moreover be used to hang the bottle to a support structure suitable for the purpose (not shown). In order to prevent unnoticed opening of closure 1, a capsule 13 is placed around the opening in the neck of the bottle which must be damaged before closure 1 can be taken out of neck 11.

Figure 2:
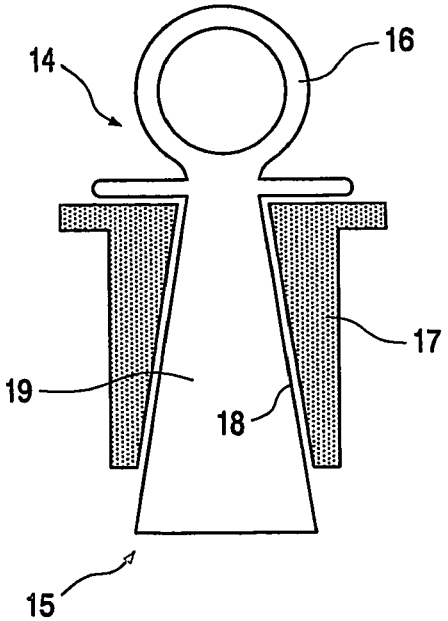
FIG. 2 shows a cross-section through an alternative embodiment variant of a closure according to the invention.

FIG. 2 shows a cross-section through a closure 14 with an operating member 15 provided with an annular grip 16 and a plug 17. Other than in the closure 1 shown in FIGS. 1A-1E, the surfaces of a recess 18 in plug 17 and a core 19 of operating member 15 widen as the distance from grip 16 increases. A reverse effect is hereby obtained from that in FIGS. 1A-1E. This means that in order to lock the closure 14 the operating member must here be pulled further out of plug 17 on the side of grip 16 and, in order to release closure 14, the grip 16 must be moved to plug 17.

Figure 3:
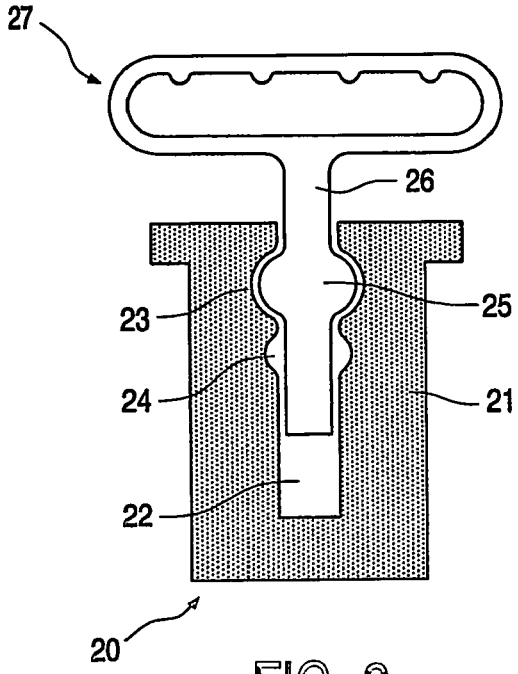
FIG. 3 shows a cross-section through a second alternative embodiment variant of a closure according to the invention.

FIG. 3 shows yet another variant of a closure 20 according to the invention with a plug 21 in which is arranged a recess 22 opened to one side. Preformed in recess 22 are two bearings 23, 24 which are adapted to receive a thickened portion 25 located in a core 26 of operating member 27. Bearing 24 is smaller than bearing 23, so that when the thickened portion 25 is placed into bearing 24, closure 20 can be fixed, while when the thickened portion 25 is placed into the larger bearing 23 the plug 21 has precisely the smaller size for placing or removing closure 20.

The invention claimed is:

1. A closure for a liquid container, comprising: a plug manufactured from at least partially flexible material with a recess which is arranged at least substantially in axial direction in the plug and which is accessible on at least one side, and an operating member protruding outside the plug and displaceable in the recess such that a force exerted by the operating member on the recess in the plug can be modified by displacing the operating member, wherein the operating member has a hollow core portion opened on one side and at least one channel connecting the hollow core portion to an opening, wherein the hollow core portion provides for the passage of gas from the inside of the liquid container through the at least one channel which leads to a surface of the operating member in contact with the recess in the plug.

2. The closure as claimed in claim 1, wherein the forces exerted by the operating member are variable such that the size of the plug can be modified.

3. The closure as claimed in claim 1, wherein the operating member is displaceable relative to the plug between an active position, in which the operating member exerts a force on the recess in the plug, and a release position in which the operating member exerts no force, or at least a smaller one, on the recess in the plug.

4. The closure as claimed in claim 1, wherein the recess arranged in the plug is formed such that it has a wall part enclosing an angle with the axis of the recess.

5. The closure as claimed in claim 1, wherein the surface of the operating member in contact with the wall of the recess has a wall part enclosing an angle with the axis of the recess.

6. The closure as claimed in claim 1, wherein the recess in the plug is accessible from two sides.

7. The closure as claimed in claim 1, wherein the plug is provided with a sealing ring enclosing a side of the plug remote from the recess.

8. The closure as claimed in claim 1, wherein the operating member is provided with anchoring means for non-releasable coupling of the plug and the operating member.

9. The closure as claimed in claim 1, wherein the part of the operating member protruding outside the plug is provided with a grip.

10. The closure as claimed in claim 1, wherein the plug is manufactured from a material with a greater flexibility than the flexibility of the material from which the operating member is made.

11. The closure as claimed in claim 1, wherein the plug and the operating member are manufactured from plastic.

12. The closure as claimed in claim 1, wherein the wall of the recess in the plug and the side of the operating member co-acting with the recess are profiled such that the contact surface between the recess and the plug is limited.

13. The closure as claimed in claim 1, wherein the operating member comprises a first channel which leads to a surface portion of the operating member in contact with the recess in the plug and a second channel which leads to a surface portion of the operating member that is not in contact with the recess in the plug.

14. The closure as claimed in claim 1, wherein the closure is provided with anchoring means for the purpose, in a position in which the operating member exerts a force on the wall of the recess in the plug, of mutually anchoring the operating member and the plug with a determined clamping force.

15. The closure as claimed in claim 14, wherein at least the wall of the recess in the plug or the side of the operating member co-acting with the recess comprises at least one annular member encircling the operating member.

16. The closure as claimed in claim 14, wherein the anchoring means comprise at least one annular member encircling the recess in the plug.

* * * * *